US010995587B2

(12) United States Patent
Cui

(10) Patent No.: US 10,995,587 B2
(45) Date of Patent: May 4, 2021

(54) REVERSING VALVE FOR HYDRAULIC PISTON PUMP

(71) Applicant: Nailin Cui, Heilongjiang (CN)

(72) Inventor: Nailin Cui, Heilongjiang (CN)

( * ) Notice: Subject to any disclaimer, the term of this patent is extended or adjusted under 35 U.S.C. 154(b) by 28 days.

(21) Appl. No.: 16/688,759

(22) Filed: Nov. 19, 2019

(65) Prior Publication Data

US 2020/0088009 A1 Mar. 19, 2020

Related U.S. Application Data

(63) Continuation-in-part of application No. PCT/CN2018/000217, filed on Jun. 7, 2018.

(30) Foreign Application Priority Data

Aug. 4, 2017 (CN) ..... 201710683380.7

(51) Int. Cl.
*E21B 34/14* (2006.01)
*E21B 43/12* (2006.01)
*F04B 49/22* (2006.01)

(52) U.S. Cl.
CPC ..... *E21B 34/14* (2013.01); *E21B 43/121* (2013.01); *F04B 49/22* (2013.01); *E21B 2200/06* (2020.05)

(58) Field of Classification Search
CPC .... E21B 34/14; E21B 43/121; E21B 2200/06; E21B 43/126; F04B 49/22; F04B 47/08; F04B 9/1095; F04B 53/10; F04B 9/103; F04B 49/225; F04B 9/109
See application file for complete search history.

(56) References Cited

U.S. PATENT DOCUMENTS 2,943,576 A * 7/1960 English ..... F04B 47/04 417/377
4,118,154 A * 10/1978 Roeder ..... E21B 43/129 417/402
4,768,589 A * 9/1988 Roeder ..... F04B 47/08 166/106
4,778,355 A * 10/1988 Holland ..... F04B 47/08 417/378
7,156,058 B1 * 1/2007 Lou ..... F01L 9/10 123/90.12

(Continued)

FOREIGN PATENT DOCUMENTS

CN 2340938 Y 9/1999
CN 201407152 Y 2/2010

(Continued)

*Primary Examiner* — Michael R Wills, III

(57) ABSTRACT

A reversing valve for a hydraulic piston pump, including a pilot valve and a main valve. The pilot valve includes a pilot valve seat, a hollow valve core and a pull rod. The main valve comprises an upper valve seat, a lower valve seat and a main valve core. When the hollow valve core is at a upper position, the control flow passage communicates with the spent fluid flow passage, and the main valve core is at a lower position, so the power piston is driven to move downwardly by the power fluids provided by the main valve. When the hollow valve core is at a lower position, the power fluid controls the main valve core to be seated at the upper position, and the power piston is driven to move upwardly by the power fluids provided by the pilot valve.

7 Claims, 11 Drawing Sheets

(56) References Cited

U.S. PATENT DOCUMENTS

| | | | | |
|---|---|---|---|---|
| 8,303,272 | B2 * | 11/2012 | Pugh | F04B 53/10 417/401 |
| 10,774,628 | B2 * | 9/2020 | Knoeller | F04B 47/08 |
| 2010/0143166 | A1 | 6/2010 | Head | |

FOREIGN PATENT DOCUMENTS

| | | | |
|---|---|---|---|
| CN | 102979716 | A | 3/2013 |
| CN | 103423135 | A | 12/2013 |
| CN | 206668524 | U | 11/2017 |
| CN | 107676237 | A | 2/2018 |

* cited by examiner

REVERSING VALVE FOR HYDRAULIC PISTON PUMP

CROSS-REFERENCE TO RELATED APPLICATIONS

This application is a continuation of International Application No. PCT/CN2018/000217 with a filling date of Jun. 7, 2018, designating the United states, now pending, and further claims to the benefit of priority from Chinese Application No. 201710683380.7 with a filing date of Aug. 4, 2017. The content of the aforementioned applications, including any intervening amendments thereto, are incorporated herein by reference.

TECHNICAL FIELD

The present application relates to a hydraulic piston pump for extracting oil from wells, and more particularly to a reversing valve for controlling the reciprocating motion of the hydraulic piston pump.

BACKGROUND OF THE INVENTION

For existing hydraulic piston pumps, high-pressure power fluids are injected into oil wells by surface pumps, and sliding sleeve reversing valves in the wells control the reciprocating motion of pistons at power ends, thereby driving the piston of the pump to reciprocate. As shown in FIGS. 1-2 a motor 101 drives a high-pressure plunger pump to suck a power fluid from a separator 103, and after pressurized, the power fluid is injected to a downhole sliding sleeve reversing valve 120 and a piston motor 150 via a power string 108, Finally the piston motor 150 drives a pump 160 reciprocating to lift crude oils to the surface. In FIG. 1, 107 is a perforation section of oil formation; 104 is a flowmeter; 105 is a pressure gauge and 106 is an oil well casing. In FIG. 2, 120 is a sliding sleeve reversing valve; 121 is a sliding reversing pilot rod; 153 is a power piston, 151 is a power piston rod and 163 is a pump piston. Hydraulic piston pump belongs to rodless oil production device, which is most suitable for deviated and horizontal wells. It not only has high efficiency and high lift-head, but also can use high temperature power fluid to keep wellbore temperature to solve the flow problem of heavy oil and high pour point crude oil.

However, the existing hydraulic piston pumps use sliding sleeve reversing valve to control the reciprocating direction of the power piston, which causes the following shortcomings of the hydraulic piston pumps. Firstly, since the sliding sleeve reversing valve cannot achieve low pump stroke reversing, the power fluids are required to have good lubricity to reduce the abrasion of moving members. Secondly, the power fluids are required to have good cleanliness, and the fit clearance of the sliding sleeve reversing valve is very precise. In order to prevent the sliding sleeve from jamming, the power fluids must be fine filtered. Thirdly, since members of the sliding sleeve reversing valve is in clearance fit, the power fluids are required to have an appropriate viscosity; If water and other low viscous fluids are used as power fluid, not only the moving parts will wear rapidly but also the leakage of sliding sleeve valve will be very serious. In the last century, crude oils are used as the power fluid of the hydraulic piston pump in worldwide oil fields, that is the produced fluid is used as the power fluid after dewatered, finely filtered and heated. However, after the water cut of oil wells increased, the workload of surface treatment of power fluid was too large, the production cost was too high. By the end of the last century, because the water cut of oil wells was high, China has no use of hydraulic piston pumps as artificial lift method, and the number of hydraulic piston pumps used in the United States has also significantly decreased. Therefore, in the field of artificial lift, it is always hoped that a hydraulic piston pump is capable of using water or produced fluid from well as power fluid.

SUMMARY OF THE INVENTION

A primary object of the present invention is to provide a reversing valve for a hydraulic piston pump. The hydraulic piston pump designed with the reversing valve can use pure water or high water content produced liquid as the power fluid, thereby eliminating the complex equipment on the surface for handling the power fluid and saving the energy consumption in the process of treatment.

Another object of the present invention is to provide a reversing valve for a hydraulic piston pump. The hydraulic piston pump designed with the reversing valve can work at a very low pump stroke, thereby greatly improving the reliability of the pump and increasing the working life of the pump.

Yet another object of the present invention is to provide a reversing valve for a hydraulic piston pump. The hydraulic piston pump designed with the reversing valve has a small leakage, thereby significantly improving efficiency and reducing energy consumption.

Still yet another object of the present invention is to provide a hydraulic piston pump reversing valve which its manufacturing cost is significantly lower than that of a sliding sleeve reversing valve.

The hydraulic piston pump reversing valve provided by the present invention is a structure which replaces the sliding sleeve reversing valve of the existing hydraulic piston pumps with a combination of two two-position three-way cone valves to realize the above objectives of the present invention. The reversing valve consists of a pilot valve and a main valve, the pilot valve includes a pilot valve seat, a hollow valve core, a pull rod and a seal sleeve. The pilot valve seat is equipped with a first seal ring and a second seal ring, seal sleeve is equipped with a third seal ring, A first seal line is formed at a junction between an upper end face of the pilot valve seat and its inner diameter, and a second seal line is formed at a junction between a lower end face of the pilot valve seat and its inner diameter. The hollow valve core is provided with a first conical surface and a second conical surface. A first cylinder is arranged above the first conical surface and a second cylinder is arranged below the second conical surface. A convex cylinder is arranged above the second conical surface, and a seal cylinder is arranged above the convex cylinder.

Pilot valve seat and seal sleeve are fixed in a pilot valve housing, and hollow valve core is installed in the pilot valve seat and the seal sleeve. The seal cylinder on the hollow valve core dynamically matches with an inner diameter of the seal sleeve. An outer diameter of the seal cylinder is equal to an inner diameter of the pilot valve seat. An upper end of the pull rod is provided with a trigger which is provided with a flow hole on a bottom, A lowest end of the pull rod is fixed at the top of the upper piston rod. The pilot valve is also provided with a high-pressure chamber, a control connecting port, a spent fluid connecting port, a power inlet port, a lower alternate flow passageway, a spent fluid passageway and a control passageway. A first annular flow passage is formed between the hollow valve core and the pull rod, and a second annular flow passage is formed between an outer surface of the hollow valve core and an inner surface of the pilot valve seat.

A damping flow passage is formed between the outer surface of the convex cylinder and an inner surface of a lower end of the seal sleeve. The damping flow passage can choose different flow area according to flow rate of a spent fluid and the flow area is 2-350 $mm^2$.

The main valve includes an upper valve seat, a lower valve seat, an upper seal sleeve, a lower seal sleeve and a cylinder sleeve. The upper valve seat, the lower valve seat, the upper seal sleeve, the lower seal sleeve and the cylinder sleeve are all arranged in the main valve housing. The main valve also includes a main valve core which is a stepped shaft structure with thick in a middle and thin at both ends. An upper end of the main valve core is provided with an upper conical surface. A top cylinder is arranged above the upper conical surface. A lower end of the main valve core is provided with a lower conical surface. A bottom cylinder is arranged below the lower conical surface. The main valve core is processed into a large cylinder in the middle. and an upper cylinder and a lower cylinder are respectively provided on upper and lower sides of the middle cylinder. The cross-sectional area of the middle cylinder is A; a cross-sectional area of the upper cylinder is B, and is equal to a cross-sectional area of the lower cylinder; a cross-sectional area of the top cylinder is C, and is equal to a cross-sectional area of the bottom cylinder, In order to control the opening and closing of the main valve core, the section area (A-B)>B should be guaranteed. The main valve core is also provided with a radial breathing hole and a longitudinal breathing hole, a throttle valve is arranged at a tail of the main valve core and provided with a damping hole; The throttle valve can be machined with cemented carbide or ceramic. The throttle valve is equipped with a damping hole which diameter can be selected according to structural parameters of the main valve, the diameter range of damping hole 25 is 0.2-20 mm.

A fourth seal ring is provided on the upper valve seat of the main valve, and a fifth seal ring is provided on the lower valve seat; a sixth seal ring and a seventh seal ring are respectively provided on outer and inner surfaces of the upper seal sleeve, and an eighth seal ring and a ninth seal ring are respectively provided on outer and inner surfaces of the lower seal sleeve. A tenth seal ring is provided on a main valve core; The fourth, fifth, sixth, eighth seal rings are static seals, while the seventh, ninth and tenth seal rings are dynamic seals. The upper end of the main valve is also equipped with a fixed nut, and the outermost layer is an oil well casing. The main valve is also provided with a power chamber, a first connection chamber, a second connection chamber, a spent fluid chamber, a breathing chamber and a control chamber. The main valve is also provided with an upper power flow passage and an upper alternate flow passage. The power chamber communicates with the high-pressure chamber through the upper power flow passage, the lower power flow passage, the power fluid inlet port and the first annular flow passage. An upper end of the control flow passage communicates with the control chamber, and A middle of the control flow passage communicates with the control connection port and a lower end of the control flow passage communicates with a lower working chamber of a power piston. An upper end of the upper alternate flow passage communicates with the first connection chamber, and a middle of the upper alternate flow passage communicates with the second connection chamber, and a lower end of the upper alternate flow passage communicates with the lower alternate flow passage. The lower alternate flow passage connects to an upper working chamber of the power piston. An upper end of the spent fluid passage communicates with the spent fluid chamber, and a lower end of the spent fluid outlet passage communicates with the spent fluid outlet port, and an well annular. The radial breathing hole on the main valve core communicates with the breathing chamber and the longitudinal breathing hole, the longitudinal breathing hole communicates with the damping hole, and the damping hole communicates with the spent fluid chamber which is connects with the well annular through spent fluid passage.

When the power piston of a power end travels close to a dead point of its stroke in a power cylinder barrel, the hollow valve core is driven to change its position by the trigger or a top of upper piston rod, and is seated with pilot seat under a action of hydraulic pressure. Thus, flow directions of a power fluid in respective flow passages of the pilot valve are changed. Switch position of the main valve core is controlled by the control connection port, the control flow passage and the control chamber on the main valve. Therefore, the flowing direction of power fluid and spent fluid can be changed, so that a moving direction of the power piston can be controlled. In short, when the hollow valve core is at an upper position, the control flow passage communicates with the spent fluid connection port, and a pressure of the control chamber is equal to that of the breathing chamber. Since a pressure of the power chamber is larger than that of the spent fluid chamber, the main valve core is forced to locate at a lower position, and the connection between the second connection chamber and the spent fluid chamber is blocked. The power fluid supplied by the main valve passes through the upper alternate flow passage and the lower alternate flow passage to force the power piston to move downwardly. When the hollow valve core is at a lower position, the power fluid enters the control chamber through the control connection port and the control flow passage. Since an upward resultant force applied on the main valve core is greater than the downward resultant force applied on the main valve core, the main valve core is forced to seat at an upper position. The power fluid provided by the pilot valve 10 forces the power piston to go up in the power cylinder and the power piston drives the pull rod to move. The trigger on the pull rod and a top end of the upper piston rod provide an initial action for the hollow valve core, and then a hydraulic force pushes it to the reversing position.

During reversing, the reversing valve of the hydraulic piston pump of the present invention eliminates or reduces the vibration and impact of the main valve by providing the damper hole on the main valve core, so that it can smoothly reverse under different operating conditions, thereby extending the service life of the reversing valve. Because the reversing valve adopts the structure of two two-position three-way cone valves, the valve seats and valve cores are linearly sealed, and eliminating leakage during working, and the valve core will not be stuck due to impure power fluid. The reversing valve no longer needs the power fluid with good lubricity, high cleanliness and proper viscosity, and pure water or fluid with high water content and low viscosity can be directly used as power fluid. Another advantage is that the reversing valve can be realized low pump stroke (less than 3 times per minute). This greatly reduces the moving speed of the moving members to reduce the abrasion, and increases the service life of the whole system several times. The above-mentioned advantages can not be achieved by the existing sliding sleeve reversing valve of hydraulic piston pump.

The preferred embodiment of the present invention now will be described in detail with reference to the accompanying drawings.

DETAILED DESCRIPTION OF EMBODIMENTS

Figure 1:
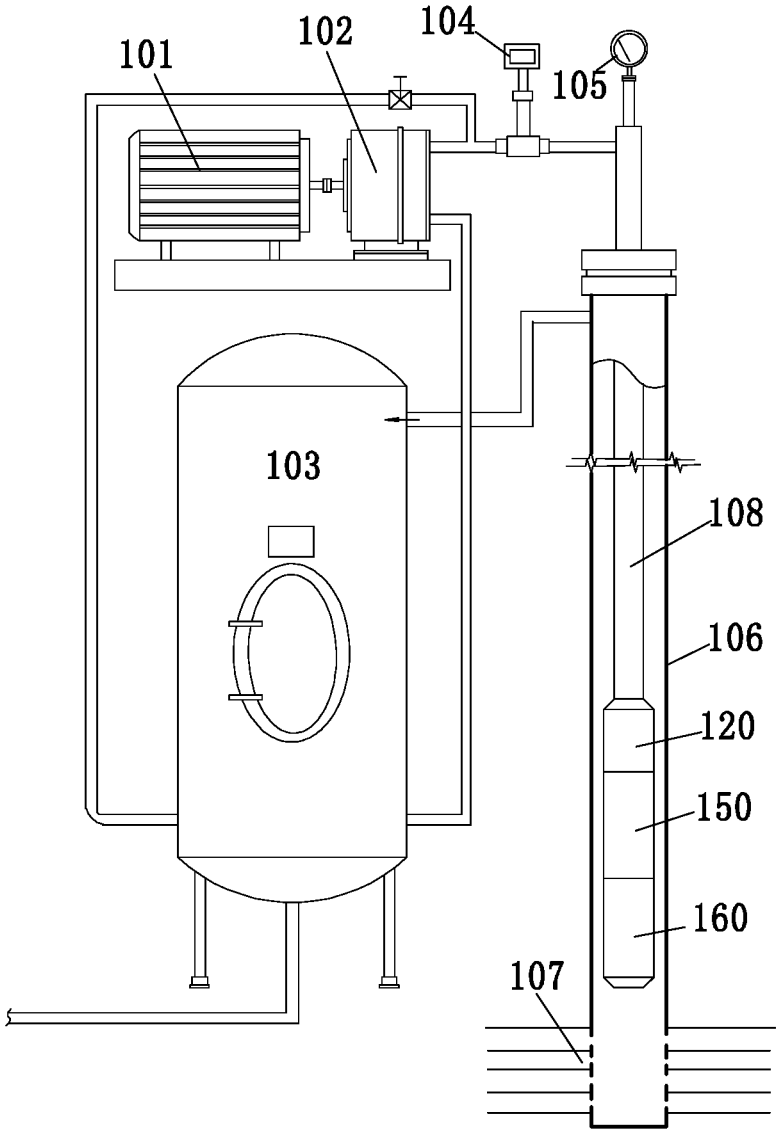
FIG. 1 (Prior Art)
FIG. 1 is a schematic diagram of surface installation and a downhole pump of a hydraulic piston pump in the prior art.
Figure 2:
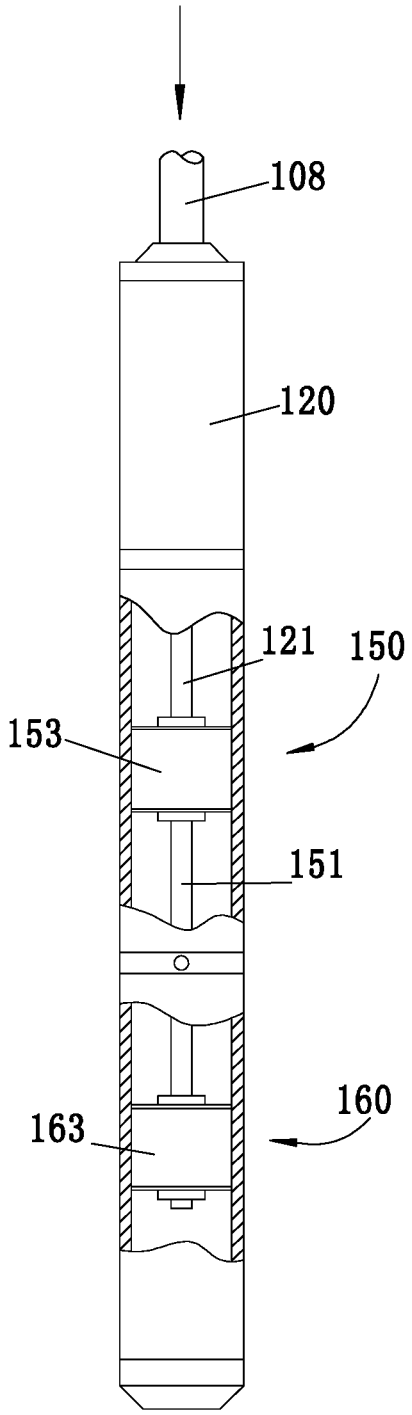
FIG. 2 (Prior Art)
FIG. 2 is a partial sectional view of the downhole pump of the hydraulic piston pump in the prior art.
Figure 3A:
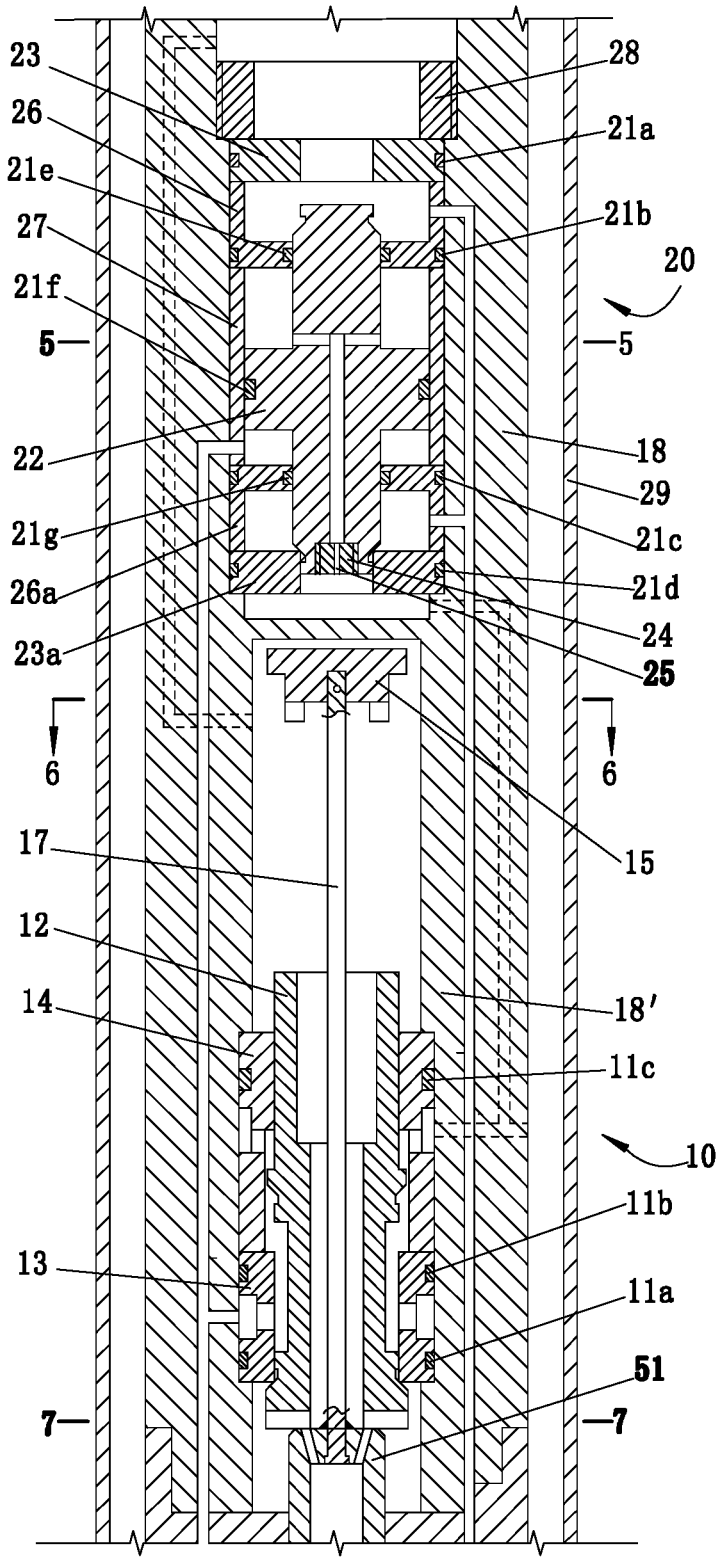
FIG. 3A is a schematic diagram of a reversing valve of a hydraulic piston pump according to the present invention.
Figure 3B:
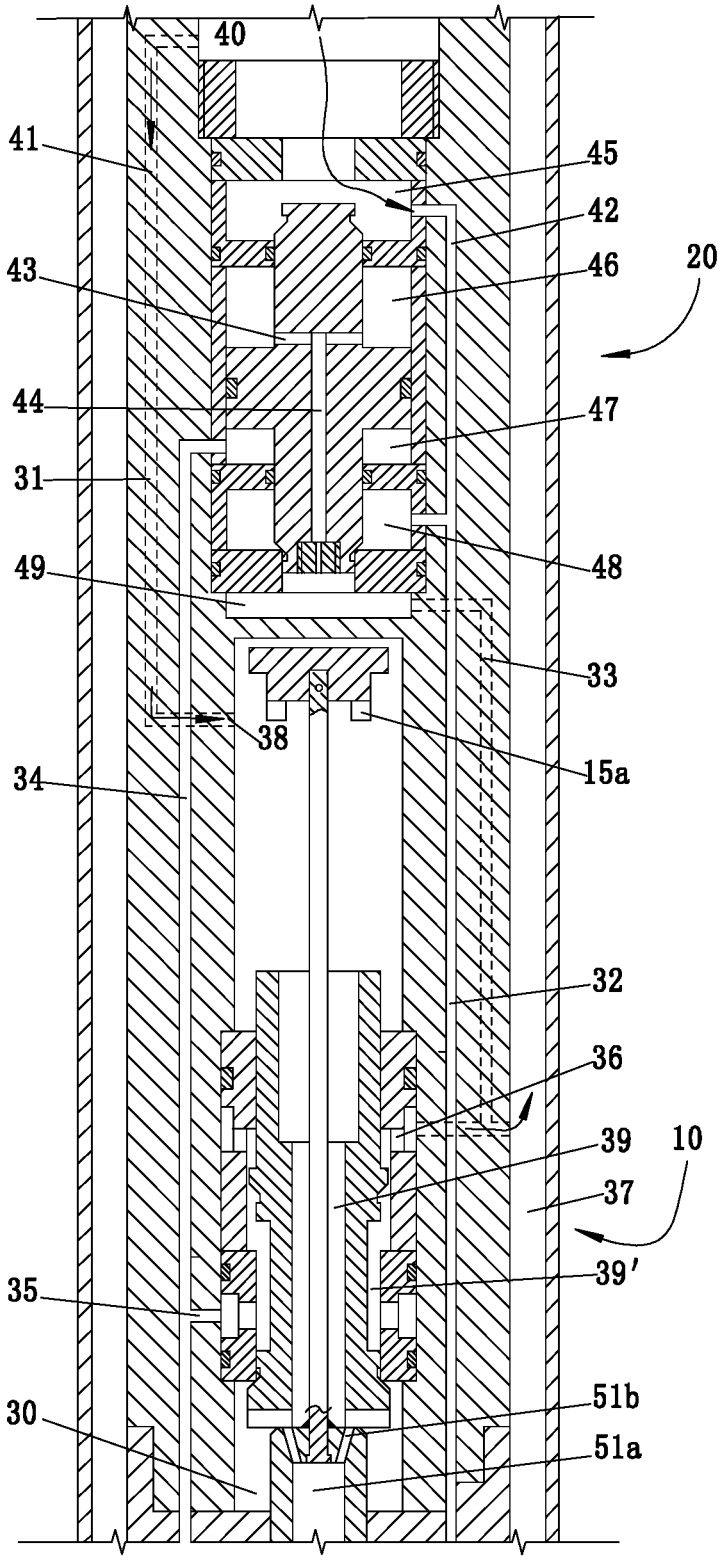
FIG. 3B is a schematic diagram of the reversing valve showing connections of respective chambers and respective flow passage ways of the present invention when the main valve core is driven to its lower position.

As for FIG. 3A and FIG. 3B, it needs to be explained that FIG. 3A and FIG. 3B are exactly the same in view. The difference is that each number on FIG. 3A represents the components of the reversing valve, and each number on FIG. 3B represents the chambers, connecting ports and flow passages of the reversing valve.

Figure 8:
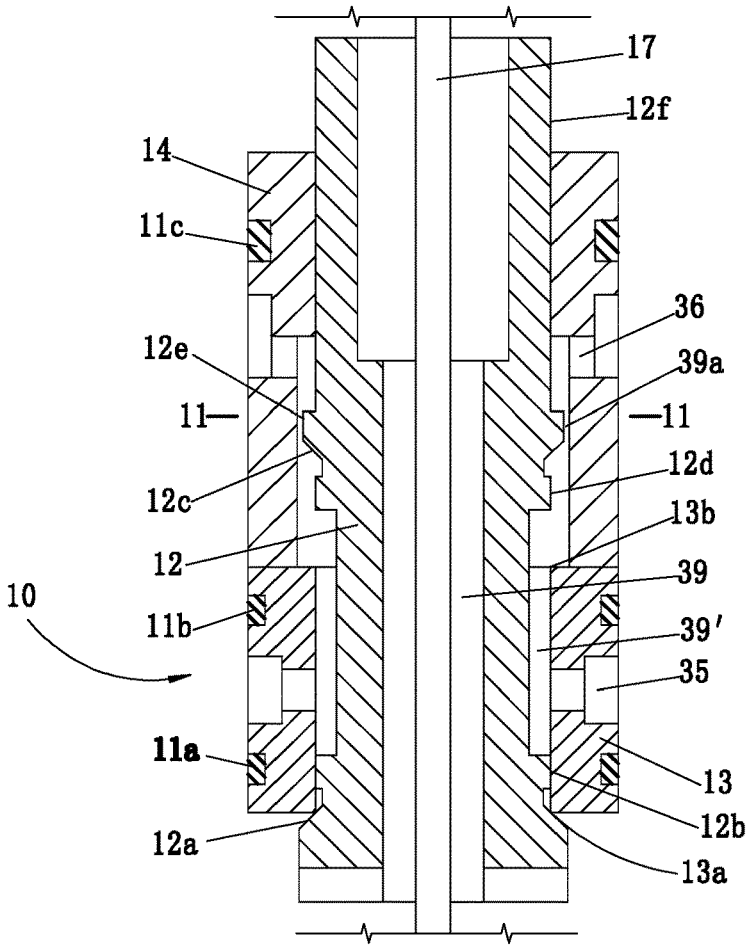
FIG. 8 is an enlarged sectional view of a pilot valve of the reversing valve of the present invention.
Figure 11:
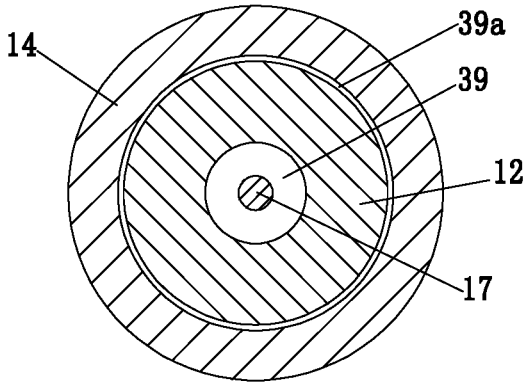
FIG. 11 is a cross-sectional view taken along line 11-1 of FIG. 8.

As shown in FIGS. 3A and 8, a first sealing line 13*a* is formed at a junction between a lower end face and an inner surface of the pilot valve seat 13 and a second sealing line 13*b* is formed between an upper end face of the pilot valve seat 13 and its inner surface, and a first conical surface 12*a* and a second conical surface 12*c* are arranged on the hollow valve core 12. There is a first cylinder 12*b* above the first conical surface 12*a*, a second cylinder 12*d* below the second conical surface 12*c*. A convex cylinder 12*e* is provided above the second conical surface 12*c*, and a sealing cylinder 12*f* is arranged above the convex cylinder 12*e*. The pilot valve 10 also includes a pull rod 17 and a seal sleeve 14. A first seal ring 11*a* and a second seal ring 11*b* are installed on the pilot seat 13. A third seal ring 11*c* is installed on the seal sleeve 14. The pilot valve seat 13 and the seal sleeve 14 are fixed in a pilot valve housing 18'. The hollow valve core 12 is installed in the pilot valve seat 13 and seal sleeve 14. The seal cylinder 12*f* on the hollow valve core 12 dynamically matches with an inner diameter of seal sleeve 14. In order to ensure an axial force balance of the hollow valve core 12, an outer diameter of the seal cylinder 12*f* is required to be equal to an inner diameter of the pilot valve seat 13. A top end of the pull rod 17 is provided with a trigger 15 which is provided with a flow hole 15*a* on a bottom, and the lowest end of the pull rod 17 is fixed at a top of an upper piston rod 51. As shown in FIG. 3B, the pilot valve 10 is also provided with a high-pressure chamber 30, a control connecting port 35, a spent fluid connecting port 36, power fluid inlet port 38, a lower alternate flow passage way 32, a spent fluid outlet passage way 33 and control passage way 34. As shown in FIGS. 8 AND 11, a first annular flow passage 39 is formed between the hollow valve core 12 and the pull rod 17, a second annular flow passage 39' is formed between an outer surface of the hollow valve core 12 and an inner surface of the pilot valve seat 13.

An annular damping flow passage 39*a* is formed between an outer surface of the convex cylinder 12*e* and an inner surface of a lower end of the seal sleeve 14. The damping flow passage 39*a* can choose different flow area according to the flow rate of a spent fluid and the flow area is 2-350 $mm^2$.

Figure 9:
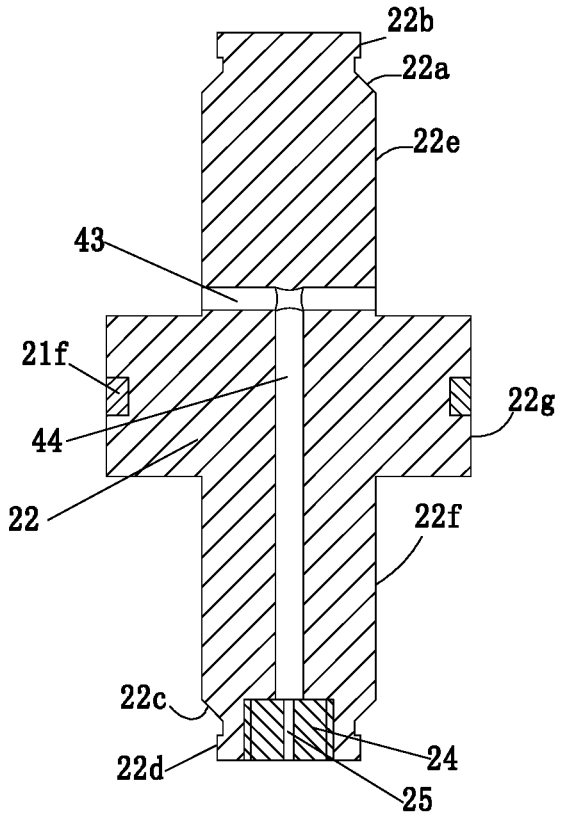
FIG. 9 is an enlarged sectional view of a main valve core of the reversing valve of the present invention.
Figure 10:
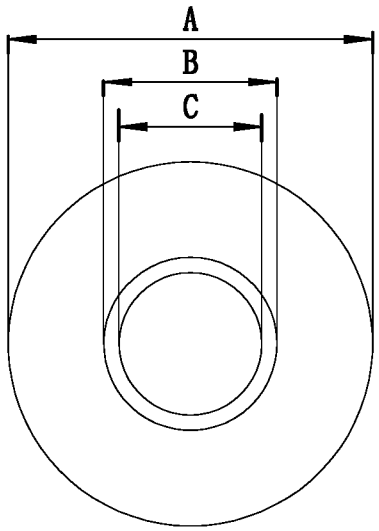
FIG. 10 is a top view of the main valve core of the reversing valve of the present invention.

The main valve 20 includes an upper valve seat 23, a lower valve seat 23*a*, an upper seal sleeve 26, a lower seal sleeve 26*a* and a cylinder sleeve 27. The upper valve seat 23, the lower valve seat 23*a*, the upper seal sleeve 26, the lower seal sleeve 26*a* and the cylinder sleeve 27 are all installed in the main valve housing 18 according to an order in FIG. 3A. As shown in FIGS. 9 and 10, the main valve 20 also includes a main valve core 22. The main valve core 22 is a stepped shaft structure with thick in a middle and thin at both ends. An upper end of the main valve core 22 is provided with an upper conical surface 22*a*. A top cylinder 22*b* is arranged above the upper conical surface 22*a*. A lower end of the main valve core 22 is provided with a lower conical surface 22*c*. A bottom cylinder 22*d* is arranged below the lower conical surface 22*c*. The main valve core 22 is processed into a large cylinder 22*g* in a middle, and an upper cylinder 22*e* and a lower cylinder 22*f* are respectively provided on upper and lower sides of the middle cylinder 22*g*. A cross-sectional area of the middle cylinder 22*g* is A; a cross-sectional area of the upper cylinder 22*e* is B, and is equal to a cross-sectional area of the lower cylinder 22*f*; a cross-sectional area of the top cylinder 22*b* is C, and is equal to a cross-sectional area of the bottom cylinder 22*d*, In order to control the opening and closing of the main valve core 22, it should be ensured that a difference between A and B is larger than B. The main valve core 22 is also provided with a radial breathing hole 43 and a longitudinal breathing hole 44, A throttle valve 24 is arranged at a tail of the main valve core 22 and is made of cemented carbide or ceramic. The throttle valve 24 is equipped with a damping hole 25 (shown in FIGS. 3B and 9), which diameter can be selected according to the structural parameters of the main valve 20, the diameter range of damping hole 25 is 0.2-20 mm.

Figure 4A:
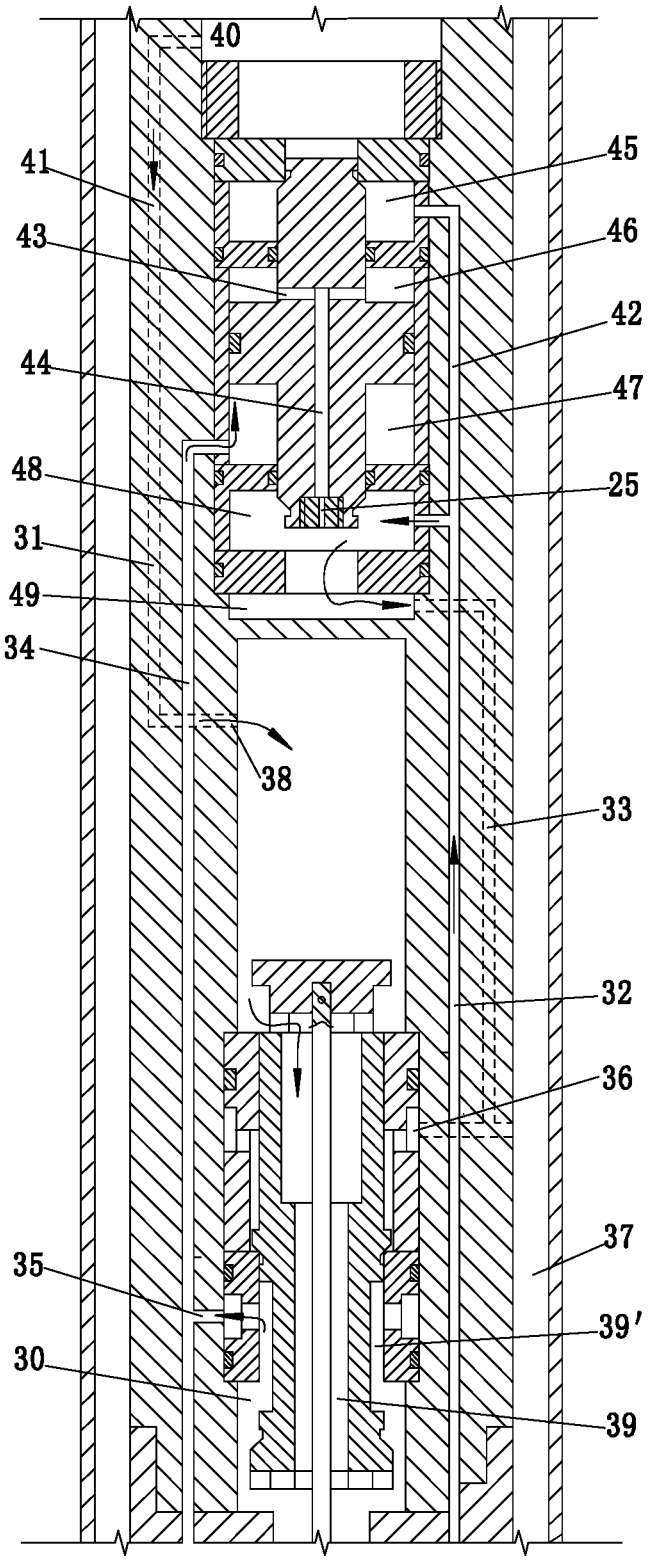
FIG. 4A is a schematic diagram of the reversing valve showing connections of respective chambers and respective flow passage ways of the present invention when the main valve core is driven to its upper position.
Figure 5:
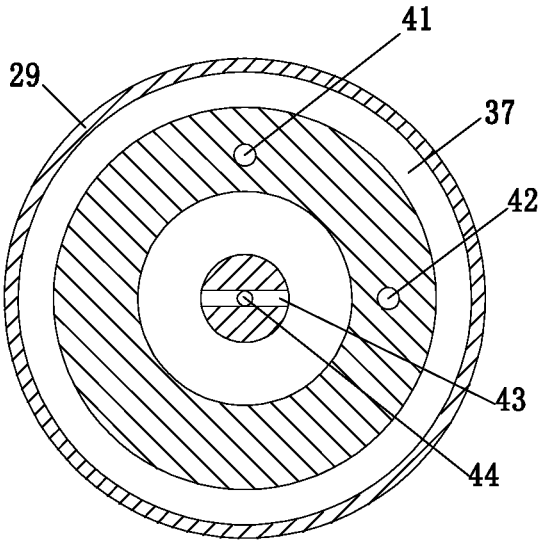
FIG. 5 is a cross sectional view taken along line 5-5 of FIG. 3A.
Figure 6:
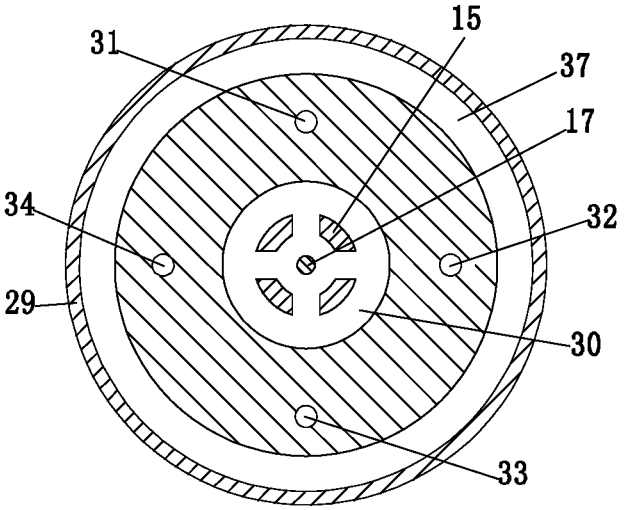
FIG. 6 is a cross sectional view taken along line 6-6 of FIG. 3A.
Figure 7:
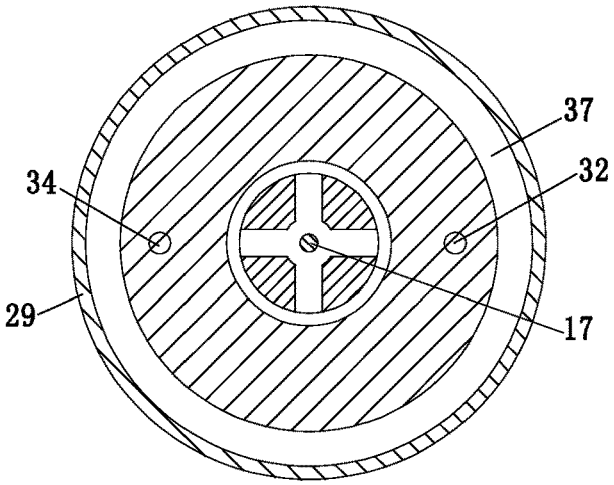
FIG. 7 is a cross sectional view taken along line 7-7 of FIG. 3A.

The upper valve seat 23 of the main valve 20 is equipped with a fourth seal ring 21*a*, the lower valve seat 23*a* is equipped with a fifth seal ring 21*d*, and an inner and outer surfaces of the upper seal sleeve 26 is equipped with a sixth seal ring 21*b* and a seventh seal ring 21*e* respectively. An inner and outer surfaces of the lower seal sleeve 26*a* are respectively equipped with a eighth seal ring 21*c* and a ninth seal ring 21*g*. The main valve core 22 is equipped with a tenth seal ring 21*f* (shown in FIG. 3A). The fourth, fifth, sixth and eighth seal rings 21*a*, 21*d*, 21*b*,21*c* are static seals, while the seventh, ninth and the tenth seal rings 21*e*, 21*g*, 21*f* are dynamic seals. Above the upper end of the main valve 20 is also equipped with a fixed nut 28, and the outermost layer is an oil well casing 29. As shown in FIG. 4A, the main valve 20 is also provided with a power chamber 40, a first connection chamber 45, a second connection chamber 48, a spent fluid chamber 49, a breathing chamber 46 and a control chamber 47. The main valve 20 is also equipped with an upper power flow passage 41 and an upper alternate flow passage 42. Numeral 37 in FIG. 4A indicates a well annular. It should be noted that the upper power fluid passage 41, the lower power flow passage 31 and the spent fluid flow passage 33 are indicated by dotted lines in the drawings, which is intended to illustrate the connection relationship among the chambers of the reversing valve of the present invention. and their actual positions thereof are shown in FIGS. 5-7. The power chamber 40 communicates with the high-pressure chamber 30 through the upper power flow passage 41, the lower power flow passage 31, the power inlet port 38 and the first annular flow passage 39. An upper end of the control flow passage 34 communicates with the control chamber 47, and a middle of the control flow passage 34 communicates with the control connection port 35, and a lower end of the control flow passage 34 communicates with a lower working chamber 55 of a power piston 53. An upper end of the upper alternate flow passage 42 communicates with the first connection chamber 45, and a middle of the upper alternate flow passage 42 communicates with the second connection chamber 48, and a lower end of the upper alternate flow passage 42 communicates with the lower alternate flow passage 32 communicating with an upper working chamber 54 of the power piston 53. An upper end of the spent fluid flow passage 33 communicates with the spent fluid chamber 49, and a lower end of the spent fluid passage 33 communicates with the spent fluid outlet port 36, and at the same time communicates with the well annular 37. The radial breathing hole 43 on the main valve core 22 communicates with the breathing chamber 46 and the longitudinal breathing hole 44, the longitudinal breathing hole 44 communicates with the damping hole 25, and the damping hole 25 communicates with the spent fluid chamber 49 which communicates with the well annular 37 through spent fluid flow passage 33.

Figure 3C:
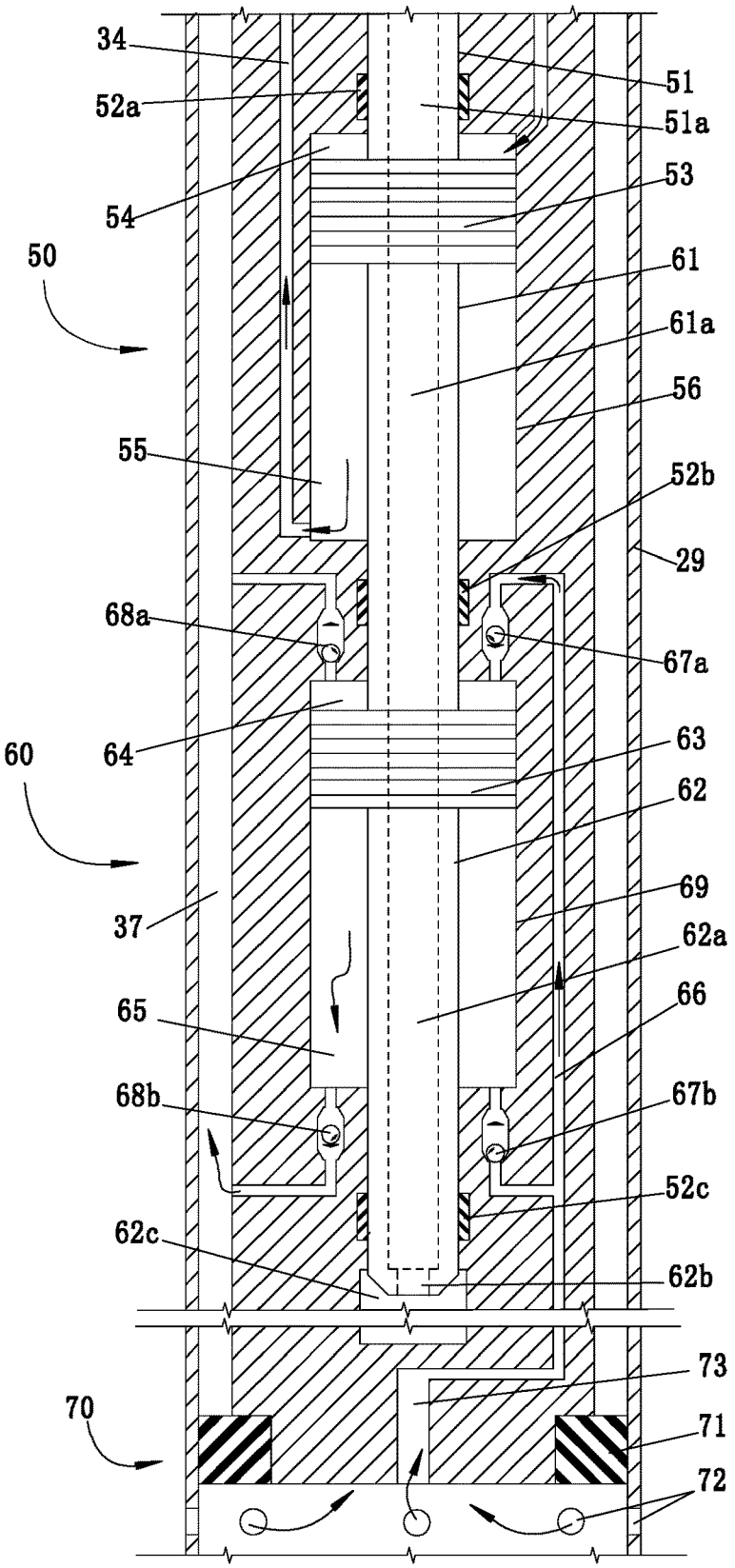
FIG. 3C is a schematic diagram of the hydraulic piston pump driven by the reversing valve of the present invention, in which the hydraulic piston pump is at a beginning of its down stroke.

In order to clearly illustrate the working principle of the reversing valve, this embodiment illustrates the reversing valve of the present invention based on the power end and pump end of the A-type hydraulic piston pump (TRICO INDUSTRIES INC., US). Specifically speaking, the reversing valve with the sliding sleeve in the A-type hydraulic piston pump is replaced by the reversing valve of the present invention, and other components at the power end and the pump end are retained. FIGS. 3A and 3C are cross-sectional views of the A-type pump designed with the reversing valve of the present invention, in which the hydraulic piston pump is at the beginning of its down stroke. The A-type pump includes a power end 50; where 51 is an upper piston rod; 51*a* is a hollow passage of the upper piston rod 51. An upper end of the upper piston rod 51 is provided with an obliquely connection passage 51*b* (shown in FIG. 3B), and the hollow passage 51*a* communicates with the high-pressure chamber 30 on the pilot valve 10 via the obliquely connection passage 51*b*. It should be noted that the bottom end of the pull rod 17 is fixed with the top of the upper piston rod 51, so the pull rod 17 synchronously reciprocates as the upper piston rod 51 reciprocates. 52*a* is a dynamic seal of the upper piston rod 51; 53 is a power piston; 54 is an upper working chamber of the power piston; 55 is a lower working chamber of the power piston 53; and 56 is a power cylinder. As shown in FIG. 3C, the A-type pump further comprises a pump assembly 60, where 61 is a power piston rod; 61*a* is a hollow passage of the power piston rod 61; 63 is a pump piston; 64 is an upper working chamber of the pump piston 63; 65 is a lower working chamber of the pump piston 63; 67*a* is an upper suction valve; 67*b* is a lower suction valve; 68*a* is an upper discharge valve; 68*b* is a lower discharge valve; and 69 is a pump cylinder. 52*b* is a dynamic seal of the power piston rod 61. A balanced piston rod 62 is also installed at the lower end of the pump piston 63 to ensure the force balance of the power piston 53 during reciprocating operation, a hollow passage way 62*a* is arranged in the centre of the balanced piston rod 62. The pump assembly 60 also includes a dynamic seal 52*c* for the balance piston rod 62 and a suction flow passage 66. A balance communication hole 62*b* is provided at a bottom end of the balance piston rod 62 to connect the hollow passage way 62*a* with a balance chamber 62*c*. The A-type pump further comprises a suction end 70. The well annular 37 and a perforation section 72 are separated by a packer 71. 73 is a pump intake, and fluids from an oil formation enter the lower suction valve 67*b* and the upper suction valve 67*a* by passing through the pump intake 73 and the suction flow passage 66.

Referring to FIGS. 3B, 8 and 3C, the first conical surface 12*a* on the hollow valve core 12 is seated with the first sealing line 13*a* of the pilot valve seat 13, and the power fluid in the high-pressure chamber 30 is sealed off. At the same time, the control chamber 47 communicates with the spent fluid outlet port 36 via the control flow passage 34, the control connection port 35, the second annular flow passage 39' and the annular damping flow passage 39*a*. Because of the effect of annular damping flow passage 39*a*, a flow resistance of the spent fluid is generated. It is this flow resistance that pushes the hollow valve core 12 upward and keeps it at an upper position. At this time, pressures in the breathing chamber 46 and the control chamber 47 of the main vale 20 are the same, which are all the pressure from the spent fluid. Bottom end face of the valve core 22 is subjected to the spent fluid pressure, and top end face of the valve core 22 is subjected to the power fluid pressure. Because the power fluid pressure is much larger than the spent fluid pressure, the main valve core 22 is in a position shown in FIG. 3B. At this time, the high-pressure power fluid from the power chamber 40 enters the first connection chamber 45, and then enters the upper working chamber 54 of the power piston 53 through the upper alternate passage 42 and the lower alternate passage 32, and drives the power piston 53 to go down in the power cylinder barrel 56. At the same time, the spent fluid in the lower working chamber 55 is forced to enter the control flow passage 34, and then is discharged into the well annular 37 through the control connection port 35, the second annular flow passage 39', the damping flow passage 39*a* and the spent fluid outlet port 36 of the pilot valve 10, and finally the spent fluid, together with produced fluids, is lifted to the surface. As shown in FIG. 3C, when the power piston 53 goes down, the power piston rod 61 drives the pump piston 63 goes down in the pump cylinder barrel 69. At the same time, the upper suction valve 67*a* and the lower discharge valve 68*b* are opened; and the lower suction valve 67*b* and the upper discharge valve 68*a* are closed. Thus fluids in well enters the upper working chamber 64, and the fluids in the lower working chamber 65 is discharged into the well annular 37 and is lifted to the surface.

Figure 4B:
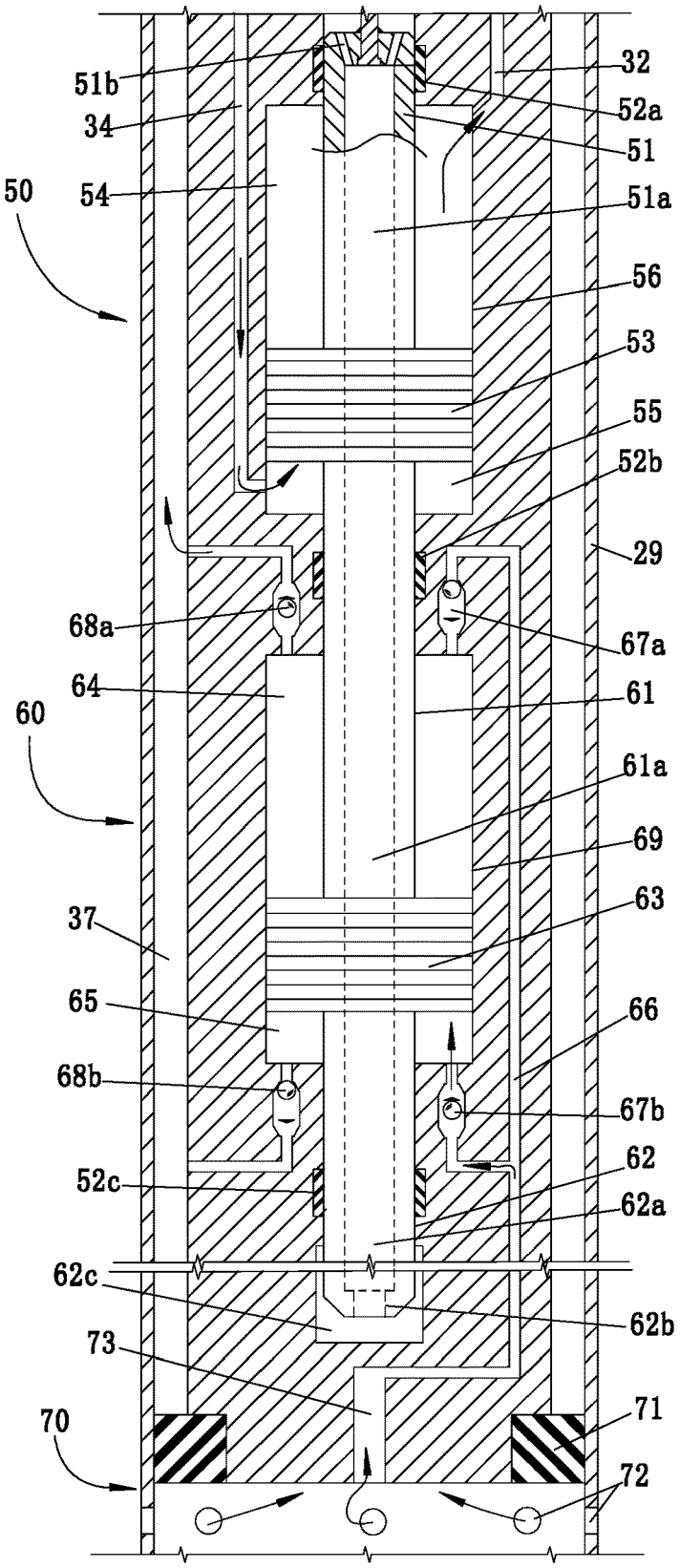
FIG. 4B is a schematic diagram of the hydraulic piston pump driven by the reversing valve of the present invention, in which the hydraulic piston pump is at a beginning of its up stroke.

As shown in FIG. 4A, when the power piston 53 of a power end runs close to a lower dead point of down stroke, the upper piston rod 51 drives the trigger 15 on a top of the pull rod 17 to push the hollow valve core 12 to move downwardly, so that the second conical surface 12*c* on the hollow valve core 12 is seated with the second seal line 13*b* on the pilot valve seat 13. At the same time, the high-pressure chamber 30 communicates with the second annular flow passage 39', and the second annular flow passage 39' is disconnected with the spent fluid outlet port 36. The power fluid from the power chamber 40 flows out of the control connection port 35 through the power inlet port 38 and the first annular passage 39 and is divided into two ways. One way of the power fluids enters the control chamber 47 of the main valve 20 through the control flow passage 34. Since an upward resultant force applied on the main valve core 22 is larger than a downward resultant force applied on the main valve core 22, the main valve core 22 is forced to be at a position shown in FIG. 4A. Therefore, a connection between the power chamber 40 and the first connection chamber 45 is closed, and the second connection chamber 48 communicates with the spent fluid chamber 49, so that constitutes a communication between the lower alternate flow passage 32 and the spent fluid chamber 49. At this time, the other way of high-pressure power fluid from the power chamber 40 enters the lower end of the control passage 34 and flows into the lower working chamber 55 of the power piston 53, and pushes the power piston 53 upward, and at the same time, the spent fluid in the upper working chamber 54 is forced to enter the second connection chamber 48 through the lower alternate flow passage 32, then discharged into the well annular 37 through the spent fluid chamber 49 and the spent fluid flow passage 33, and finally the spent fluid together with the produced liquid is lifted to the surface. As shown in FIG. 4B, when the power piston 53 moves up, the power piston rod 61 drives the pump piston 63 to move upwardly. At this time, the upper discharge valve 68*a* and the lower suction valve 67*b* are opened; and the lower discharge valve 68*b* and the upper suction valve 67*a* are closed. The fluids in the well enters the lower working chamber 65 of the pump, and the fluids in the upper working chamber 64 of the pump is discharged to the well annular 37, and is then lifted to the surface.

When the power piston is close to the dead point of its up stroke, the hollow core 12 is pushed by the upper piston rod 51 to move upwardly, so that the connections of the flow passages are changed, which causes changes of pressure in the respective chambers of the main valve 20, Then the main valve core 22 is restored to the position of FIG. 3A. Next, the power piston 53 starts its down stroke again.

The above described reversing valve with a double-acting hydraulic piston pump is only one embodiment of the reversing valve disclosed by the present invention and this embodiment is not intended to limit the reversing valve of the present invention. The reversing valve of the present invention can be used to design various hydraulic piston pumps including double-acting pumps, single-acting pumps and ultra-high lift-head piston pumps with multiple power pistons. Furthermore, reciprocating piston pumps driven by downhole electric rotary hydraulic pumps can also be designed by adopting the reversing valve of the present invention. It should be noted that any hydraulic piston pumps designed based on the principles of the reversing valve of the present invention should fall within the scope of the present invention. Any modifications and changes can be made to the reversing valve without departing from the principles of the present invention, which shall fall within the scope of the present invention.

I claim:

1. A reversing valve for a hydraulic piston pump, comprising:

a pilot valve; and a main valve;

wherein the pilot valve includes a pilot valve seat, a hollow valve core, a pull rod and a seal sleeve; the pilot valve seat is equipped with a first seal ring and a second seal ring, the seal sleeve is equipped with a third seal ring; the pilot valve seat and the seal sleeve are fixed in a pilot valve housing; the hollow valve core is installed in the pilot valve seat and the seal sleeve; a seal cylinder on the hollow valve core dynamically matches with an inner diameter of the seal sleeve; an upper end of the pull rod is provided with a trigger which is provided with a flow hole on a bottom, and a lower end of the pull rod is fixed at a top of an upper piston rod; the pilot valve is further provided with a high-pressure chamber, a control connection port, a spent fluid outlet port, a power inlet port, a lower alternate flow passage, a spent fluid flow passage and a control flow passage; a first annular flow passage is formed between the hollow valve core and the pull rod, and a second annular passage is formed between an outer surface of the hollow valve core and an inner surface of the pilot valve seat;

the main valve comprises an upper valve seat, a lower valve seat, an upper seal sleeve, a lower seal sleeve and a cylinder sleeve which are arranged in a main valve housing; a fourth seal ring is provided on the upper valve seat, and a fifth seal ring is provided on the lower valve seat; a sixth seal ring and a seventh seal ring are respectively provided on outer and inner surfaces of the upper seal sleeve, and an eighth seal ring and a ninth seal ring are respectively provided on outer and inner surfaces of the lower seal sleeve; a tenth seal ring is provided on a main valve core; the fourth, fifth, sixth, eighth seal rings are in a static seal, and the seventh, ninth and tenth seal rings are in a dynamic seal; the upper part of the main valve is equipped with a fixed nut;

the main valve further comprises the main valve core having a stepped shaft structure which is thick in a middle and thin at both ends; a radial breathing hole and a longitudinal breathing hole are provided in the main valve core; a throttle valve is arranged at a tail of the main valve core and provided with a damping hole; the main valve is provided with a power chamber, a first connection chamber, a second connection chamber, a spent fluid chamber, a breathing chamber, a control chamber, an upper power flow passage and an upper alternate flow passage; wherein the power chamber is connected to the high-pressure chamber through the upper power flow passage, the lower power flow passage, the power inlet port and the first annular flow passage; an upper end of the control flow passage communicates with the control chamber, and a middle of the control flow passage communicates with the control connection port, and a lower end of the control flow passage communicates with a lower working chamber of a power piston; an upper end of the upper alternate flow passage communicates with the first connection chamber, and a middle of the upper alternate flow passage communicates with the second connection chamber, and a lower end of the upper alternate flow passage communicates with the lower alternate flow passage communicating with an upper working chamber of the power piston; an upper end of the spent fluid flow passage communicates with the spent fluid chamber, and a lower end of the spent fluid flow passage communicates with the spent fluid outlet port and an well annular;

when the power piston of a power end travels close to a dead point of its stroke in a power cylinder barrel, the hollow valve core is driven to change positions by the trigger or the top of upper piston rod, and is seated with pilot valve seat under an action of hydraulic pressure, so that flow directions of a power fluid in respective flow passages of the pilot valve are changed, and a switch position of the main valve core is controlled.

2. The reversing valve of claim 1, wherein the hollow valve core is provided with a first conical surface and a second conical surface; a first cylinder is provided above the first conical surface, and a second cylinder is provided below the second conical surface.

3. The reversing valve of claim 1, wherein the hollow valve core is provided with a convex cylinder; the convex cylinder and the inner surface of the seal sleeve form a damping flow passage which has a flow area of 2-350 mm2.

4. The reversing valve of claim 1, wherein an outer diameter of the sealing cylinder is equal to an inner diameter of the pilot valve seat.

5. The reversing valve of claim 1, wherein an upper conical surface is provided at an upper end of the main valve core, and a top cylinder is provided above the upper conical surface; a lower conical surface is provided at a lower end of the main valve core, and a bottom cylinder is provided below the lower conical surface.

6. The reversing valve of claim 1, wherein the main valve core has a middle cylinder and an upper cylinder, and a difference between a cross-sectional area of the middle cylinder and a cross-sectional area of the upper cylinder is larger than the cross-sectional area of the upper cylinder.

7. The reversing valve of claim 1, wherein a diameter of the damping hole ranges from 0.2 mm to 20 mm.

* * * * *